US007730548B1

(12) United States Patent
McCraney

(10) Patent No.: US 7,730,548 B1
(45) Date of Patent: Jun. 8, 2010

(54) BALLISTICS VEST PAD COVER

(75) Inventor: Karen P. McCraney, Naples, FL (US)

(73) Assignee: Survival Armor, Inc., Fort Myers, FL (US)

( * ) Notice: Subject to any disclaimer, the term of this patent is extended or adjusted under 35 U.S.C. 154(b) by 467 days.

(21) Appl. No.: 11/580,442

(22) Filed: Oct. 13, 2006

(51) Int. Cl.
*F41H 1/02* (2006.01)
*F41H 5/00* (2006.01)

(52) U.S. Cl. ..... 2/2.5; 89/36.01

(58) Field of Classification Search ..... 2/2.5, 2/94, 96, 102, 69, 97, 462, 467; 89/36.01, 89/36.02, 36.05; 428/911
See application file for complete search history.

(56) References Cited

U.S. PATENT DOCUMENTS

| | | | | |
|---|---|---|---|---|
| 3,055,133 | A * | 9/1962 | Anderson | 40/586 |
| 3,398,406 | A | 8/1968 | Waterbury | |
| 4,198,707 | A | 4/1980 | Haupt et al. | |
| 4,413,357 | A | 11/1983 | Sacks | |
| 4,510,200 | A | 4/1985 | Samowich | |
| 4,637,074 | A * | 1/1987 | Taheri | 2/456 |
| 5,063,614 | A | 11/1991 | McSheffery | |
| 5,127,105 | A | 7/1992 | Sacks | |
| 5,471,906 | A | 12/1995 | Bachner, Jr. et al. | |
| 6,526,862 | B1 | 3/2003 | Lyons | |
| 6,704,934 | B2 | 3/2004 | Graham et al. | |
| 6,845,513 | B2 | 1/2005 | Field et al. | |
| 6,997,218 | B1 * | 2/2006 | Garcia et al. | 141/98 |
| 7,080,411 | B2 * | 7/2006 | Kerr | 2/2.5 |
| 2005/0193459 | A1 | 9/2005 | Field et al. | |
| 2006/0030226 | A1 | 2/2006 | Park et al. | |

* cited by examiner

*Primary Examiner*—Tejash Patel
(74) *Attorney, Agent, or Firm*—The Livingston Firm; Edward M. Livingston, Esq.; Bryan L. Loeffler, Esq.

(57) ABSTRACT

A ballistics vest pad cover (4) having at least one side that is transparent, thereby permitting a user to easily view the condition of the ballistics vest pad (3). In addition, because at least one side is transparent, a user will be able to readily determine which side should be facing towards the body. An optional label (9) may be placed on the body-face side of the cover (5) so as to provide an additional means of indicating the body-face side of the cover (5) and ballistics vest pad (7). Because the user will be able to easily view the ballistics vest pad (3), he or she will always be aware of the condition of the ballistics vest pad (3) and may replace the ballistics vest pad (3) and cover (4) as needed. As the user no longer needs to guess whether the ballistics vest pad (3) is still in good condition, lives will be saved. In addition, the number of injuries occurring from wearing the ballistics vest pad (3) incorrectly will be dramatically reduced.

24 Claims, 1 Drawing Sheet

BALLISTICS VEST PAD COVER

BACKGROUND OF THE INVENTION

This invention relates to armored vests, more particularly, a cover for a ballistics vest pad that permits a user to quickly and easily view the ballistics vest pad.

Currently, armored vests, which are also referred to as bullet-proof vests, comprise three main components: a ballistics vest pad having body-face side and an opposing strike-face side, a non-removable cover (which is also referred to as a pad cover) and a carrier. The ballistics vest pad is encased within the pad cover. A label is placed on the cover of one side of the pad, either the strike-side or the body-side, so as to indicate to the wearer how to insert the pad. When a person desires to use the armored vest, he or she inserts the covered ballistics vest pad into the carrier such that the body-face side of the ballistics cover is against the body and, depending on the type of armored vest, is worn underneath or over the person's clothing.

Oftentimes, however, problems may occur wherein a person, due to carelessness, does not read the label on the cover and inadvertently places the ballistics vest pad into the carrier wherein the body-face portion is not facing the body. As the ballistics vest pad is designed wherein the strike-face side is able to withstand the impact of a bullet greater than the body-face side, this mistake could cost the wearer his or her life.

In addition, the ballistics vest pad of the armored vest is normally warranted for only five years. However, as the condition of the armored vest is determined by the amount of use, five years is a only a general guideline. For example, if an armored vest is receiving considerable use, then the condition of the armored vest is greatly diminished well before five years whereas an armored vest that is rarely used may have a life-span well over five years. In addition, if the ballistics vest pad gets wet with sweat, water or other liquid, there is a great likelihood that the ballistics vest pad will become moldy. Also, some fabrics used to make ballistics delaminate with use. Thus, it is important for the wearer of the armored vest to know the condition of the ballistics vest pad prior to wearing the vest.

However, because the cover is opaque, the condition of the ballistics vest pad is not readily apparent. In addition, because the cover is non-removable, a person must rip open the cover to view the condition of the ballistics vest pad and, once the cover is ripped, the entire ballistics system is destroyed, requiring the purchase of a new covered ballistics vest pad. Thus, the users of armored vests rarely, if ever, check the condition of the ballistics vest pad of an armored vest as it is not convenient to do so. Unfortunately, if a person uses a ballistics vest pad that has been compromised, he or she is placing his or her life in danger wherein the potential consequence is death.

Thus, a need exists for a ballistics vest pad cover that permits a person to quickly and easily view the condition of the ballistics vest pad without damaging the covered ballistics vest pad.

The relevant prior art includes the following references:

| U.S. Pat. No. (U.S. unless stated otherwise) | Inventor | Issue/Publication Date |
|---|---|---|
| 5,127,105 | Sacks | Jul. 07, 1992 |
| 5,471,906 | Bachner, Jr. et al. | Dec. 05, 1995 |

-continued

| U.S. Pat. No. (U.S. unless stated otherwise) | Inventor | Issue/Publication Date |
|---|---|---|
| 5,063,614 | McSheffery | Nov. 12, 1991 |
| 6,704,934 | Graham et al. | Mar. 16, 2004 |
| 4,510,200 | Samowich | Apr. 09, 1985 |
| 2005/0193459 | Field et al. | Sep. 08, 2005 |
| 6,845,513 | Field et al. | Jan. 25, 2005 |
| 6,526,862 | Lyons | Mar. 04, 2003 |
| 4,413,357 | Sacks | Nov. 08, 1983 |
| 4,198,707 | Haupt et al. | Apr. 22, 1980 |
| 3,398,406 | Waterbury | Aug. 27, 1968 |

SUMMARY OF THE INVENTION

The primary object of the present invention is to provide a ballistics vest pad cover that permits a user to easily determine which side of the ballistics vest pad should be worn facing the body.

A further object of the present invention is to provide a ballistics vest pad cover that permits a user to easily view the condition of the ballistics vest pad without having to remove the cover.

An even further object of the present invention is to provide a ballistics vest pad cover that is washable.

The present invention fulfills the above and other objects by providing a ballistics vest pad cover having at least one side that is transparent, thereby permitting a user to easily view the condition of the ballistics vest pad. In addition, because at least one side is transparent, a user will be able to readily determine which side should be facing towards the body. An optional label may be placed on the body-face side of the cover so as to provide an additional means of indicating the body-face side of the cover and ballistics vest pad. In addition, an optional piece of Litmus paper may also be located within the cover so as to indicate whether the conditions within the cover are too acidic, thereby indicating that the ballistics vest pad is degrading. Because the user will be able to easily view the ballistics portion, he or she will always be aware of the condition of the ballistics vest pad and may replace the ballistics vest pad and cover as needed. As the user no longer needs to guess whether the ballistics vest pad is still in good condition, lives will be saved. In addition, the number of injuries occurring from wearing the ballistics vest pad incorrectly will be dramatically reduced.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
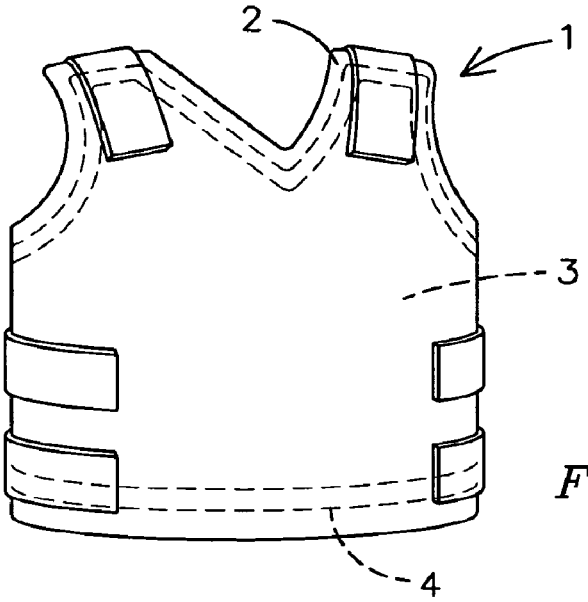
FIG. 1 is a plan perspective view of an armored vest utilizing a ballistics vest pad cover of the present invention.

For purposes of describing the preferred embodiment, the terminology used in reference to the numbered components in the drawings is as follows:

| | |
|---|---|
| 1. | armored vest, generally |
| 2. | carrier |
| 3. | ballistics vest pad |
| 4. | pad cover |
| 5. | pad cover body-face side |
| 6. | pad cover strike-face side |
| 7. | ballistics vest pad body-face side |
| 8. | ballistics vest pad strike-face side |
| 9. | label |
| 10. | pad cover body-face edge |
| 11. | pad cover strike-face edge |
| 12. | Litmus paper |

With reference to FIG. 1, a plan perspective view of a bullet-proof vest utilizing a ballistics vest pad cover of the present invention. The bullet-proof vest 1 generally has three main components: a carrier 2, a ballistics vest pad 3 and a pad cover 4. The predeterminedly sized and shaped ballistics vest pad 3 is encased within a pad cover 4, which is preferably made of thermoplastic polyurethane, and is predeterminedly sized and shaped to encase the ballistics vest pad 3. Then, the covered ballistics vest pad 3 is inserted into a carrier 2 for wearing. The carrier 2 may be of various shapes and sizes and may be adjustable so as to provide a tailored fit for the wearer. In addition, the ballistics vest pad 3 is preferably sized and shaped so as to be accommodated within a particular sized and shaped carrier 2. The pad cover 4 is preferably washable so as to maintain a sanitary ballistics cover 4.

Figure 2:
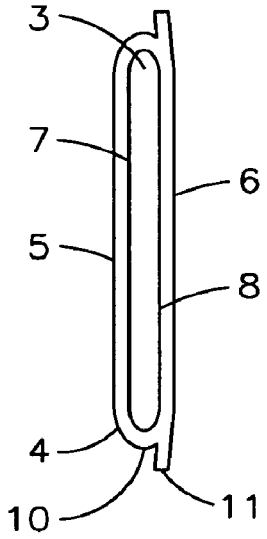
FIG. 2 is a side view of a ballistics vest pad encased within a ballistics vest pad cover of the present invention.

Next, FIG. 2 shows a side view of a ballistics vest pad encased within a ballistics vest pad cover of the present invention. The ballistics vest pad 3 has a first side which is a ballistics vest pad body-face side 7 and a second side which is a ballistics vest pad strike-face side 8 wherein the ballistics vest pad body-face side 7 is closest to a wearer's body when positioned within the carrier 2. The proper positioning of the ballistics body-face side 7 closest to the body is of great importance as the ballistics vest pad strike-face side 8 may withstand the impact of a bullet greater than the body-face side 7. The pad cover 4 has a pad cover body-face side 5 and a pad cover strike-face side 6.

The pad cover body-face side 5 has a pad cover body-face edge 10 and the pad cover strike-face side 6 has a pad cover strike-face edge 11. The edges 10 and 11 are attached to one another so as to form an encasement around the ballistics vest pad 3. When the ballistics vest pad 3 is housed within the pad cover 4, the pad cover body-face side 5 is located adjacent to the ballistics vest pad body-face side 7 and the pad cover strike-face side 6 is located adjacent to the ballistics vest pad strike-face side 8.

Figure 3:
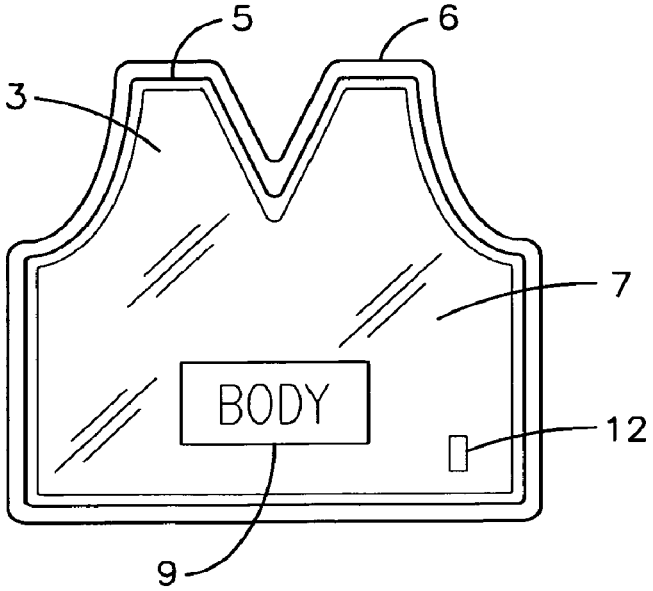
FIG. 3 is a front view of a body-face side of a ballistics vest pad encased within a ballistics vest pad cover of the present invention.

In FIG. 3, a front view of a body-face side of a ballistics vest pad encased within a ballistics vest pad cover of the present invention is shown. The pad cover body-face side 5 is preferably transparent so as to permit a wearer to easily view the ballistics vest pad body-face side 7 while the pad cover strike-face side 6 is preferably opaque and colored gray or black. In this manner, a wearer is able to quickly and easily view the entire ballistics vest pad body-face side 7 so as to determine whether the condition of the ballistics vest pad 3 is acceptable. The ability to view and examine the entire ballistics vest pad body-face side 7 is of great importance as the ballistics vest pad 3 may appear in excellent condition in one area, such as the abdominal area, but may be of poor condition in another area, such as the chest area. In addition, an optional label 9 may be located on the pad cover body-face side 5 so as to serve as an additional indicator as to the ballistics vest pad body-face side 7. An optional piece of Litmus paper 12 may also be encased within the pad cover 4 so as to readily indicate whether the conditions within the pad cover 4 are too acidic, the ramifications of which cause the degrading of the ballistics vest pad 3.

Figure 4:
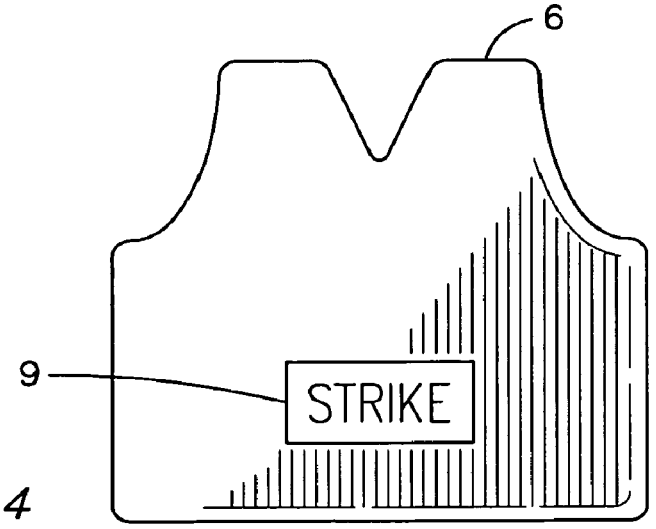
FIG. 4 is a rear view of an strike-face side of a ballistics vest pad encased within a ballistics vest pad cover of the present invention.

Finally, FIG. 4 shows a rear view of an strike-face side of a ballistics vest pad encased within a ballistics vest pad cover of the present invention. The pad cover strike-face side 6 is preferably opaque so as to readily distinguish the pad cover body-face side 5 from the pad cover strike-face side 6. However, the pad cover strike-face side 6 may be transparent as well. In addition, an optional label 9 may also be located on the pad cover strike-face side 6 as well.

The use of the present invention will permit a wearer to quickly and easily determine the condition of his or her ballistics vest pad 3 without having to remove the pad cover 4.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A ballistics vest pad cover comprising:

a ballistics vest pad of a predetermined size and shape;

said ballistics vest pad having a body-face side and an opposite strike-face side;

a pad cover having a first side and a second side;

said pad cover first side having an edge;

said pad cover second side having an edge;

wherein said pad cover first side edge is connected to said pad cover second side edge;

said pad cover encases said ballistics vest pad when said edges are connected; and said first side of said pad cover is entirely transparent so as to permit a user to view said body-face side of said ballistics vest pad.

2. The ballistics vest pad cover of claim 1 wherein:

said second side is transparent.

3. The ballistics vest pad cover 1 wherein:

said first side is a body-face side.

4. The ballistics vest pad cover of claim 1 wherein:

said second side is an strike-face side.

5. The ballistics vest pad cover of claim 2 wherein:

said first side is a body-face side.

6. The ballistics vest pad cover of claim 2 wherein:

said second side is an strike-face side.

7. The ballistics vest pad cover of claim 1 wherein:

said second side is opaque.

8. The ballistics vest pad cover of claim 3 wherein:

said second side is opaque.

9. The ballistics vest pad cover of claim 4 wherein:

said second side is opaque.

10. The ballistics vest pad cover of claim 1 further comprising:

at least one label located on said pad cover first side.

11. The ballistics vest pad cover of claim 1 further comprising:

at least one label located on said pad cover first side.

12. The ballistics vest pad cover of claim 3 further comprising:

at least one label located on said pad cover first side.

13. The ballistics vest pad cover of claim 7 further comprising:

at least one label located on said pad cover first side.

14. The ballistics vest pad cover of claim 1 further comprising:

at least one piece of Litmus paper encased within said pad cover.

15. The ballistics vest pad cover of claim 2 further comprising:

at least one piece of Litmus paper encased within said pad cover.

16. A ballistics vest pad cover comprising:

a ballistics vest pad of a predetermined size and shape;

said ballistics vest pad having a body-face side and an opposite strike-face side;

a pad cover having a body-face side;

said pad cover having an strike-face side;

said pad cover body-face side having an edge;

said pad cover strike-face side having an edge;

wherein said pad cover body-face edge is connected to said pad cover strike-face side edge;

said pad cover encases said ballistics vest pad when said edges are connected; and said body-face side of said ballistics vest pad is entirely transparent so as to permit a user to view said body-face side of said ballistics vest pad.

17. The ballistics vest pad cover of claim 16 wherein:

said strike-face side is opaque.

18. The ballistics vest pad cover of claim 16 wherein:

said strike-face side is transparent.

19. The ballistics vest pad cover of claim 16 further comprising:

at least one label located on said pad cover first side.

20. The ballistics vest pad cover of claim 17 further comprising:

at least one label located on said pad cover first side.

21. The ballistics vest pad cover of claim 18 further comprising:

at least one label located on said pad cover first side.

22. The ballistics vest pad cover of claim 16 further comprising:

at least one piece of Litmus paper encased within said pad cover.

23. A ballistics vest pad cover comprising:

a ballistics vest pad of a predetermined size and shape;

said ballistics vest pad having a body-face side and an opposite strike-face side;

a pad cover having a body-face side;

said pad cover having an strike-face side;

said pad cover body-face side having an edge;

said pad cover strike-face side having an edge;

wherein said pad cover body-face edge is connected to said pad cover strike-face side edge;

said pad cover encases said ballistics vest pad when said edges are connected;

said body-face side of said ballistics vest pad is entirely transparent so as to permit a user to view said body-face side of said ballistics vest pad;

said strike-face side is opaque; and at least one label located on said pad cover first side.

24. The ballistics vest pad cover of claim 23 further comprising:

at least one piece of Litmus paper encased within said pad cover.

* * * * *